US007841290B1

(12) United States Patent
Reitz et al.

(10) Patent No.: US 7,841,290 B1
(45) Date of Patent: Nov. 30, 2010

(54) MARINE SHAFTLESS EXTERNAL PROPULSOR

(75) Inventors: Ronald P. Reitz, Nottingham, MD (US); Gus F. Plangetis, Annapolis, MD (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 954 days.

(21) Appl. No.: 11/706,680

(22) Filed: Feb. 12, 2007

Related U.S. Application Data

(60) Provisional application No. 60/774,809, filed on Feb. 14, 2006.

(51) Int. Cl.
*B63G 8/08* (2006.01)

(52) U.S. Cl. ..... 114/337; 114/338

(58) Field of Classification Search ..... 114/312, 114/337, 338; 440/6, 49, 79–82; 416/244 B, 416/247 R, 247 A
See application file for complete search history.

(56) References Cited

U.S. PATENT DOCUMENTS

| | | | | |
|---|---|---|---|---|
| 3,101,066 | A | 8/1963 | Haselton | |
| 3,450,083 | A * | 6/1969 | Haselton et al. | 114/330 |
| 3,703,211 | A * | 11/1972 | Bernaerts | 440/79 |
| 3,805,723 | A * | 4/1974 | Bernaerts | 114/338 |
| 4,389,197 | A | 6/1983 | Ballantine | |
| 4,648,345 | A * | 3/1987 | Wham et al. | 114/338 |
| 5,028,210 | A | 7/1991 | Peterson | |
| 5,078,628 | A | 1/1992 | Garis, Jr. | |
| 5,108,323 | A | 4/1992 | Veronesi | |
| 5,257,952 | A | 11/1993 | Veronesi | |
| 5,286,116 | A * | 2/1994 | Garis, Jr. | 384/271 |
| 5,509,830 | A | 4/1996 | Garis, Jr. | |
| 5,607,329 | A | 3/1997 | Cho | |
| 6,152,791 | A | 11/2000 | Sinko | |
| 6,485,339 | B1 | 11/2002 | Hartig | |
| 6,581,537 | B2 | 6/2003 | McBride | |
| 2002/0178990 | A1 | 12/2002 | McBride | |
| 2004/0053545 | A1 | 3/2004 | Le Flem | |
| 2004/0245865 | A1 | 12/2004 | Ries | |
| 2004/0266277 | A1 | 12/2004 | Ries | |
| 2005/0170716 | A1 | 8/2005 | Ylitalo | |

FOREIGN PATENT DOCUMENTS

| | | | |
|---|---|---|---|
| JP | 03125694 | A * | 5/1991 |

* cited by examiner

*Primary Examiner*—Ajay Vasudeva
(74) *Attorney, Agent, or Firm*—Scott R. Boalick; Howard Kaiser

(57) ABSTRACT

In one general aspect, a shaftless external propulsion system as described herein provides a sleeve configured to be externally mounted over a hull of a marine vehicle. In addition, the shaftless propulsion system provides a rotor and a first stator mounted on the sleeve. The rotor includes a rotor hub that cooperates with a rotor bearing to enable the rotor to rotate about the sleeve, the rotor further comprising rotor blades attached to the rotor hub. The rotor and the first stator are disposed between a collar located at a first end of the sleeve and a collar hub located at an opposite end of the sleeve.

16 Claims, 7 Drawing Sheets

MARINE SHAFTLESS EXTERNAL PROPULSOR

CROSS-REFERENCE TO RELATED APPLICATIONS

This applications claims the benefit of U.S. Provisional Application No. 60/774,809, filed Feb. 14, 2006, which is incorporated herein by reference.

STATEMENT OF GOVERNMENT INTEREST

The following description was made in the performance of official duties by employees of the Department of the Navy, and, thus the claimed invention may be manufactured, used, licensed by or for the United States Government for governmental purposes without the payment of any royalties thereon.

TECHNICAL FIELD

The following description relates generally to a marine shaftless propulsion system, and in particular to an external shaftless propulsion system for a marine vehicle.

BACKGROUND

Shaftless propulsion systems are an alternative to the traditional shafted propeller-and-seal systems used by marine vehicles, such as undersea vehicles. Disadvantages of traditional shafted propeller-and-seal systems include mechanical vibrations and noise that propagate down the shaft and become radiated noise. The shaft itself adds considerable weight to the marine vehicle, and leaks may develop due to shaft seal wear. Shafted systems also are labor and cost intensive to both install and maintain.

A shaftless propulsion system (SPS) typically uses an electric motor integrated within the hull of the marine vehicle. One such shaftless propulsion system is described in U.S. Pat. No. 5,078,628 to Chester A. Garis, Jr. (hereinafter referred to as the '628 patent). As shown in FIGS. 1 and 3 of the '628 patent, the shaftless propulsion system is installed within the body 10 of the marine vehicle. As shown in FIG. 2 of the '628 patent, the shaftless propulsion system includes a rotor 30 and one or more stators 26, 28. In the system of the '628 patent, the two stator disks 26, 28 are secured to the body (hull) 10 of the marine vehicle and, in essence, become part of the body 10. The stators 26 and 28 and rotor 30 are disk shaped, without a drive shaft or other mechanism occupying their center. A blade hub 24 with blades 22 is attached to the rotor 30. The propeller blades 22 extend beyond the circumference of the vehicle housing. The system also includes a shroud 14 with rib supports 18 and openings 20 to accommodate rotating blades 22.

In the system of the '628 patent, the rotor 30 and the stators 26, 28 are located outside of the vessel body 10 and are cooled by the surrounding water. They operate in water and at submergent water pressure, thus requiring no complex seals between the motor and the body 10 of the vessel. The rotor 30 is positioned between the two stators 26, 28 and is accompanied by a journal bearing 48 that is positioned between the rotor 30 and the body 10. As shown in FIG. 3 of the '628 patent, the shaftless propulsion system is installed between two sections 38, 40 of the pressure hull which, after installation, are bolted and secured together. In particular, the rotor 30 is journal mounted on a central housing 44, and the rear body section 40 of the vessel can be detachably connected to the front section 38 of the vessel by a bolting flange 46 extending from the central housing 44. The rear section 40 can be connected to the flange 46 by bolts 48.

In addition to the positioning of the stators and rotors, the '628 patent discloses a cooling system that also is installed within the hull of the marine vehicle. The journal bearing 48 is water cooled and lubricated. Cooling fluid such as filtered seawater is pumped with an onboard pump through a piping system that is sea-connected. The cooling fluid is pushed out through the main fluid conduits 50 and the secondary fluid conduits 52 which lead to the journal bearing 48 and thrust bearing assemblies 54.

U.S. Pat. No. 5,509,830 to Chester A. Garis, Jr. (hereinafter referred to as the '830 patent) describes an improved cooling and lubricating system for a marine propulsor such as the propulsor described in the '628 patent. The blades of the propulsor are used to bring in cooling water, thereby dispensing with the need for a separate pump and piping system. Also, U.S. Pat. No. 5,286,116 to Chester A. Garis, Jr. (hereinafter referred to as the '116 patent) describes an improved motor and bearing assembly for use in an axial gap electric motor of a marine propulsor such as the propulsor described in the '628 patent. The bearing assembly of the '116 patent is configured to permit the stator-to-rotor gap and the bearing clearance to be adjusted after final assembly.

One of the most significant disadvantages of the shaftless propulsion system taught by the '628, '830, and '116 patents is that the stators are located within the body of the undersea marine vehicle and are attached to the hull. The problem with the system of the '628 patent stems from the fact that undersea marine vehicles compress with increasing depth during a dive. When the undersea marine vehicle dives, the hydrostatic pressure outside the hull exceeds the atmospheric pressure inside the hull. This pressure difference compresses not only the hull, but also the rotor bearing attached to the hull and the stators attached to the hull. Typical depths can compress the hull by several inches in diameter, and the compression increases with increasing depth. Although the diameter of the stators and rotor bearings of the shaftless propulsion system are reduced due to compression during a dive, the diameter of the rotor remains unchanged because the rotor is not attached to the hull and is completely immersed in the seawater surrounding the marine vehicle. As a result, the gap between the rotor and the rotor bearing increases as the depth of the marine vehicle increases. At or near the surface of the ocean, the gap between the rotor and the rotor bearing is small. At increased depth, the hull (and rotor bearing) radius decreases due to hydrostatic pressure, enlarging the gap between the rotor and the rotor bearing. The enlarged gap leads to several adverse consequences.

When the gap between the rotor and the rotor bearing increases, the rotor is able move so that it is no longer concentric with the rotor bearing and the stators. This non-concentric movement can cause several problems. For example, the windings of the stator are no longer parallel with the rotor windings, which causes reduced efficiency of the motor and reduced output of the propulsor. In addition, the surface area of the rotor bearing that is in contact with the rotor is reduced, which leads to increased bearing wear. Also, the play from the enlargement of the gap between the rotor and the rotor bearing may cause the rotor to have impact collisions with the rotor bearing when the marine vehicle changes direction. The impact collisions between the rotor and rotor bearing cause further wear of the bearing surface and also act as a source of radiated noise. Furthermore, if the space between the outer circumferential edge of the rotor blades and the shroud is not sufficient, the non-concentric movement due to an enlarged gap between the rotor and the rotor bearing may lead to collisions between the rotor blades and the shroud. Such collisions could damage the rotor blades and the shroud, and also would act as a source of radiated noise.

In summary, the shaftless propulsion system taught by the '628 patent could be rendered noisy, damaged and/or non-functional due to the dive-induced non-concentric movement of the rotor that is caused by the enlarged gap between the rotor and the rotor bearing experienced during the dive.

Another disadvantage of the shaftless propulsion system as taught by the '628, '830, and '116 patents lies with the maintenance of the system and the repair/replacement of worn or damaged parts. In order to repair or replace the shaftless propulsion system of the '628 patent, the marine vehicle must be placed in drydock. For example, the marine vehicle may need to be disassembled and/or the hull cut open in order to access the stators and rotor bearing. Placing a marine vehicle in drydock is expensive and time consuming. With respect to the problem of adjusting the rotor bearing without drydocking the vessel, the solution offered by the '116 patent is not adequate. The '116 patent attempts to address the goal of not taking the undersea vehicle apart to adjust the bearing by providing a bearing in which the gap is adjustable by manually adjusting nuts and screws, where the screws penetrate through the pressure hull. Such penetrations through the pressure hull are disadvantageous for obvious reasons.

SUMMARY

In accordance with the present invention, a marine shaftless external propulsor is disclosed herein that overcomes the disadvantages of the prior art. In particular, disclosed herein is a shaftless propulsion system that does not shrink under the compressive forces of the ocean encountered when an undersea marine vehicle dives.

According to the present invention, during a dive of the undersea marine vehicle the stator(s) and rotor of the shaftless propulsion system are completely immersed in water and are not connected directly to the hull of the undersea marine vehicle. In addition, the stators and rotor of the shaftless propulsion system of the present invention are attached to the outside of the hull of the undersea marine vehicle by an attachment mechanism. Because the hull compresses under the hydrostatic pressure encountered during a dive, the attachment mechanism must be sufficiently flexible, adjustable, and/or self-adjusting to keep the propulsion system attached to the undersea marine vehicle, provide for forward and reverse thrust, and do so while still permitting the relative motion of the hull compression to take place without adversely affecting vehicle propulsion.

In the shaftless propulsion system of the present invention, one or more stators are secured to a sleeve that is external to the hull of the undersea marine vehicle. A rotor with rotor bearing is fit over the external sleeve. A collar and collar hub attached to the sleeve secure the stator into position and prevents the rotor/stator assembly from coming apart when the rotor is rotating. The collar fits over stanchions that are connected to the hull. The stanchions are fit with springs between the collar and the edge points of the stanchion. The spring loading allows the hull of the undersea marine vehicle to compress without significant compression of the collar occurring. This arrangement enables the undersea marine vehicle to dive safely without the stator and rotor diameters shrinking as the hull of the undersea marine vehicle compresses.

In one general aspect, a shaftless external propulsion system includes a sleeve configured to be externally mounted over a hull of a marine vehicle and a rotor and first stator mounted on the sleeve. The rotor includes a rotor hub that cooperates with a rotor bearing to enable the rotor to rotate about the sleeve. The rotor further includes rotor blades attached to the rotor hub. The rotor and first stator are disposed between a collar located at one end of the sleeve and a collar hub located at the opposite end of the sleeve.

Implementations may include one or more of the following. For example, the sleeve may be removably attached to a stanchion mounted on an external surface of the hull. The stanchion may include a stanchion protrusion. The sleeve may be removably attached to the stanchion by removably attaching the collar hub to the stanchion protrusion. The collar hub may further include a collar hub bracket and the collar hub bracket may be removably attached to the stanchion protrusion. For example, the collar hub bracket may be removably attached to the stanchion protrusion by a bolt inserted through an aperture of the collar hub bracket and an aperture of the stanchion protrusion. In other implementations, the collar hub and/or the collar may be removably attached to the sleeve. Further implementations may include a fairing.

In another implementation, a second stator is mounted on the sleeve and the rotor is disposed between the first stator and the second stator. In addition, the rotor, the first stator, and the second stator are disposed between a collar located at one end of the sleeve and a collar hub located at the opposite end of the sleeve.

In yet another implementation, a first elastic member is positioned on a first surface of the stanchion protrusion between the first surface of the stanchion protrusion and a first surface of the collar hub bracket. The first elastic member may be, for example, a spring. A first damping mechanism may be positioned on the first surface of the stanchion protrusion between the first surface of the stanchion protrusion and the first surface of the collar hub bracket.

Furthermore, a second elastic member may be located on a second surface of the stanchion protrusion opposite from first surface of the stanchion protrusion and positioned between the second surface of the stanchion protrusion and a second surface of the collar hub bracket. The second elastic member may be, for example, a spring. A second damping mechanism may be positioned on the second surface of the stanchion protrusion between the second surface of the stanchion protrusion and the second surface of the collar hub bracket.

In another general aspect, a shaftless external propulsion system includes a means for supporting a propulsor, where the support means is configured to be externally mounted over a hull of a marine vehicle. The system also includes a means for mounting the support means over the hull of the marine vehicle and a propulsor. The propulsor includes a rotor and a first stator mounted on the support means. The rotor includes a rotor hub that cooperates with a rotor bearing to enable the rotor to rotate about the support means. The rotor further includes rotor blades attached to the rotor hub. The rotor and the first stator are disposed between a first means for containment of the rotor and first stator located at one end of the support means and a second means for containment of the rotor and first stator located at the opposite end of the support means.

Implementations may include one or more of the following. For example, the mounting means may further include a means for compensating for hull contraction during a dive of the marine vehicle.

In another general aspect, an attachment mechanism for attaching a shaftless external propulsion system to a hull of a marine vehicle includes an attachment surface bracket configured to be attached to an attachment surface of a shaftless external propulsion system. The shaftless external propulsion system is configured to be externally mounted over a hull of a marine vehicle. The attachment surface bracket is configured to be removably attached to a stanchion protrusion of a stanchion mounted on an external surface of the hull by a bolt inserted through an aperture of the attachment surface bracket and an aperture of the stanchion protrusion.

Implementations may include one or more of the following. For example, a first elastic member may be positioned on a first surface of the stanchion protrusion between the first surface of the stanchion protrusion and a first surface of the attachment surface bracket. Also, a second elastic member may be located on a second surface of the stanchion protrusion that is opposite from the first surface of the stanchion protrusion and positioned between the second surface of the stanchion protrusion and a second surface of the collar hub bracket.

The present invention has numerous advantages including, but not limited to, enabling the propulsor to be attached externally to the hull such that it can be removed for repairs without drydocking the undersea marine vehicle, enabling both the stator and the rotor to exist in the ocean environment such that their radii do not shrink or compress when the undersea marine vehicle dives nor do their radii expand when the undersea marine vehicle surfaces, and interfacing the collar with stanchions that are connected to the hull of the undersea marine vehicle such that the hull radius can shrink under the compression of diving conditions and expand as the undersea marine vehicle rises toward the surface, yet the external propulsor will remain attached to the undersea marine vehicle.

It is therefore an object of the present invention to provide a shaftless propulsion system that can operate such that the dimensions of the components of the shaftless propulsion system are independent of undersea marine vehicle depth. It is another object of the present invention to provide a shaftless propulsion system that has lower costs associated with the installation, removal, repair, and replacement of the shaftless propulsion system. It is a further object of the present invention to provide a shaftless propulsion system where the installation, removal, repair, and replacement of the shaftless propulsion system can be accomplished without drydocking the undersea marine vehicle.

Other objects, features, and advantages will be apparent from the description, the drawings, and the claims.

DETAILED DESCRIPTION

Figure 1:
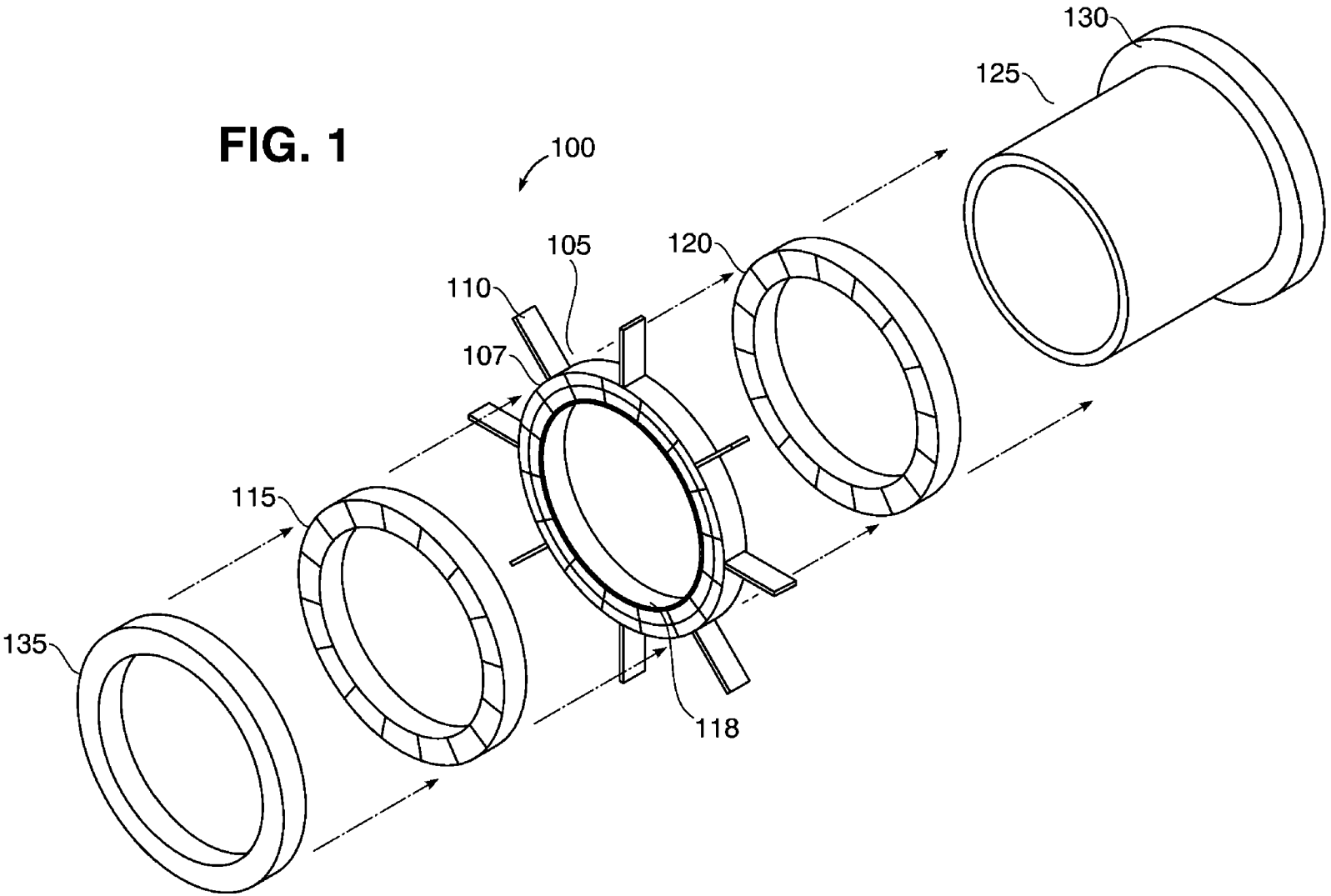
FIG. 1 is an exploded view of an exemplary shaftless propulsion system.
Figure 2:
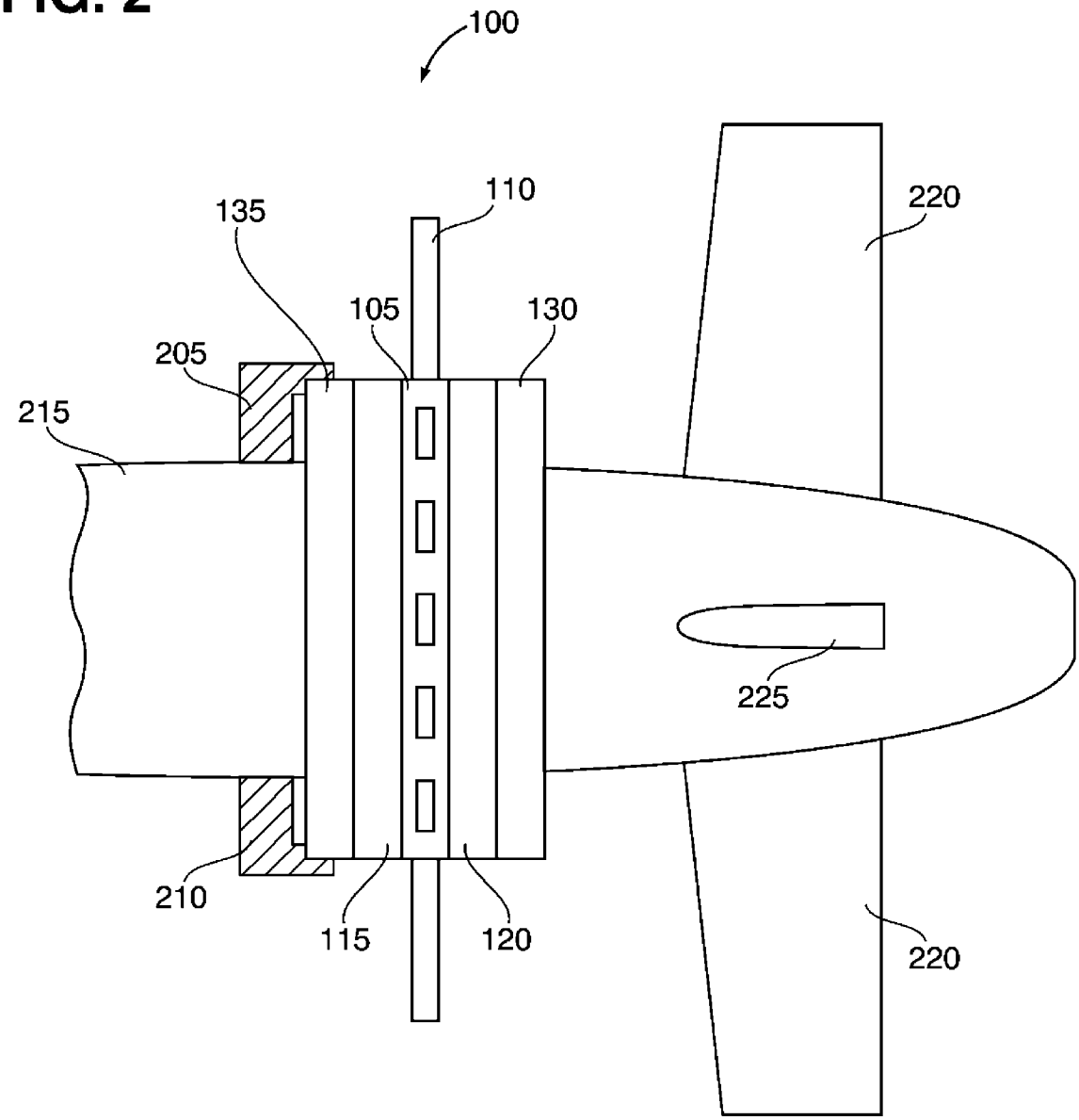
FIG. 2 is a side view of the exemplary shaftless propulsion system of FIG. 1 mounted on an exemplary marine vehicle.

As shown in FIGS. 1 and 2, a shaftless propulsion system 100 includes a rotor 105, a first stator 115, and a second stator 120 each mounted on a sleeve 125. The rotor 105 includes a rotor hub 107 and rotor blades 110. A rotor bearing 118 enables the rotor hub 107 to rotate about the sleeve 125. The rotor blades 110 act to propel the shaftless propulsion system 100 as the rotor 105 rotates about the sleeve 125.

The rotor 105, first stator 115, and second stator 120 are mounted between a collar 130 formed at one end of the sleeve 125 and a collar hub 135 attached to the opposite end of the sleeve 125. The collar 130 and collar hub 135 assist in holding the rotor 105, first stator 115, and second stator 120 in place on the sleeve 125. The collar hub 135 may be attached to the sleeve 125 using a variety of known techniques, including screws, bolts, or welding. In some implementations, the collar hub 135 may be formed as part of the sleeve 125. In other implementations, the collar 130 is removable from the sleeve 125 and may be attached to the sleeve using known techniques. Also, in some implementations the second stator 120 may be omitted.

As shown in FIG. 2, the shaftless propulsion system 100 is externally mounted on the marine vehicle. In particular, the shaftless propulsion system 100 is mounted to stanchions 205, 210 fixed to the hull 215 of the marine vehicle. Although two stanchions 205, 210 are shown, more stanchions could be used or a single stanchion could be used to mount the shaftless propulsion system 100 to the hull 215. The stanchions 205, 210 must be seaworthy. The stanchions 205, 210 may include a curtain or skirt designed to reduce turbulent flow noise. In other implementations, other known methods could be used to externally mount the shaftless propulsion system 100 to the hull 215. The shaftless propulsion system 100 is not integrated with the hull 215, but rather is designed to fit over the external surface of the hull 215.

Electrical power is supplied to the shaftless propulsion system 100 by electrical cables (not shown) extending through the hull 215. Cable openings must be properly sealed to prevent leaks from occurring. Known methods, such as compressible tubing, may be used to prevent leaks in the hull penetrations. In one implementation, electrical power is supplied by electrical cables that are run through one or more of the stanchions 205, 210 and connect to the shaftless propulsion system 100. Electrical power may be supplied to the first stator 115, the second stator 120, or the rotor 105 of the shaftless propulsion system 100, or to various combinations thereof. Usually, electric power will be supplied to the first stator 115 and the second stator 120, and the rotor 105 will be powered by magnetic induction.

In some implementations, one or more streamlined pieces (not shown) may be added in front of (i.e., forward of) and/or to the rear of (i.e., aft of) various components of the shaftless propulsion system 100 in order to streamline the flow. For example, such streamlined pieces may be added to streamline the flow over stanchions 205, 210 and collar 130 in order to avoid vortices development and subsequent noise generation. In one implementation, one or more tapered pieces of, for example, a triangular or approximately triangular cross-sectional shape (also known as a fairing) can be fastened to the hull forward of stanchions 205 and 210 and aft of collar 130. These fairings can be made in sections with a gap between the hull and the fairing to account for the hull's radial movement with changing depth and also for ease of installation. The overall shape of these fairings may be a hollowed cone through the height center axis.

Figure 3:
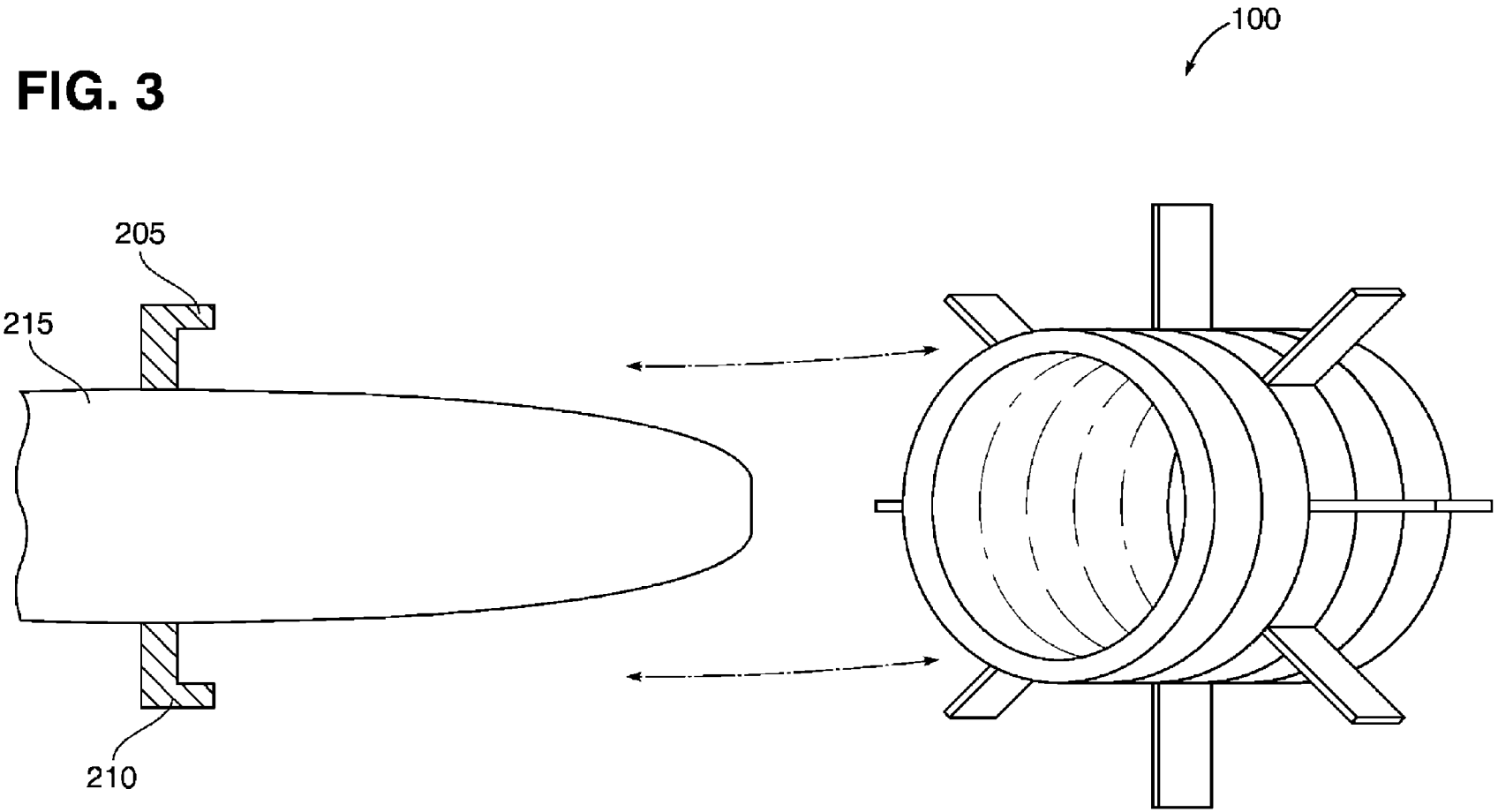
FIG. 3 illustrates the attachment and/or removal of the exemplary shaftless propulsion system of FIG. 2 to the exemplary marine vehicle.

FIG. 3 illustrates that the shaftless propulsion system 100 is removable from the hull 215. In particular, the shaftless propulsion system 100 is removably mounted to the stanchions 205, 210. As shown in FIG. 2, the shaftless propulsion system 100 typically is mounted forward of the control surfaces. The control surfaces include the rudder 220 and stern plane 225. In other implementations, the shaftless propulsion system 100 may be mounted aft of the control surfaces 220, 225. Depending upon the relative location of the shaftless propulsion system 100 and the control surfaces 220, 225, it may be necessary to at least partially remove the control surfaces 220, 225 in order to remove or install the shaftless propulsion system 100. Installation or removal of the shaftless propulsion system 100, including possible removal and re-installation of the control surfaces 220, 225, may be accomplished without placing the marine vehicle in drydock.

Figure 4:
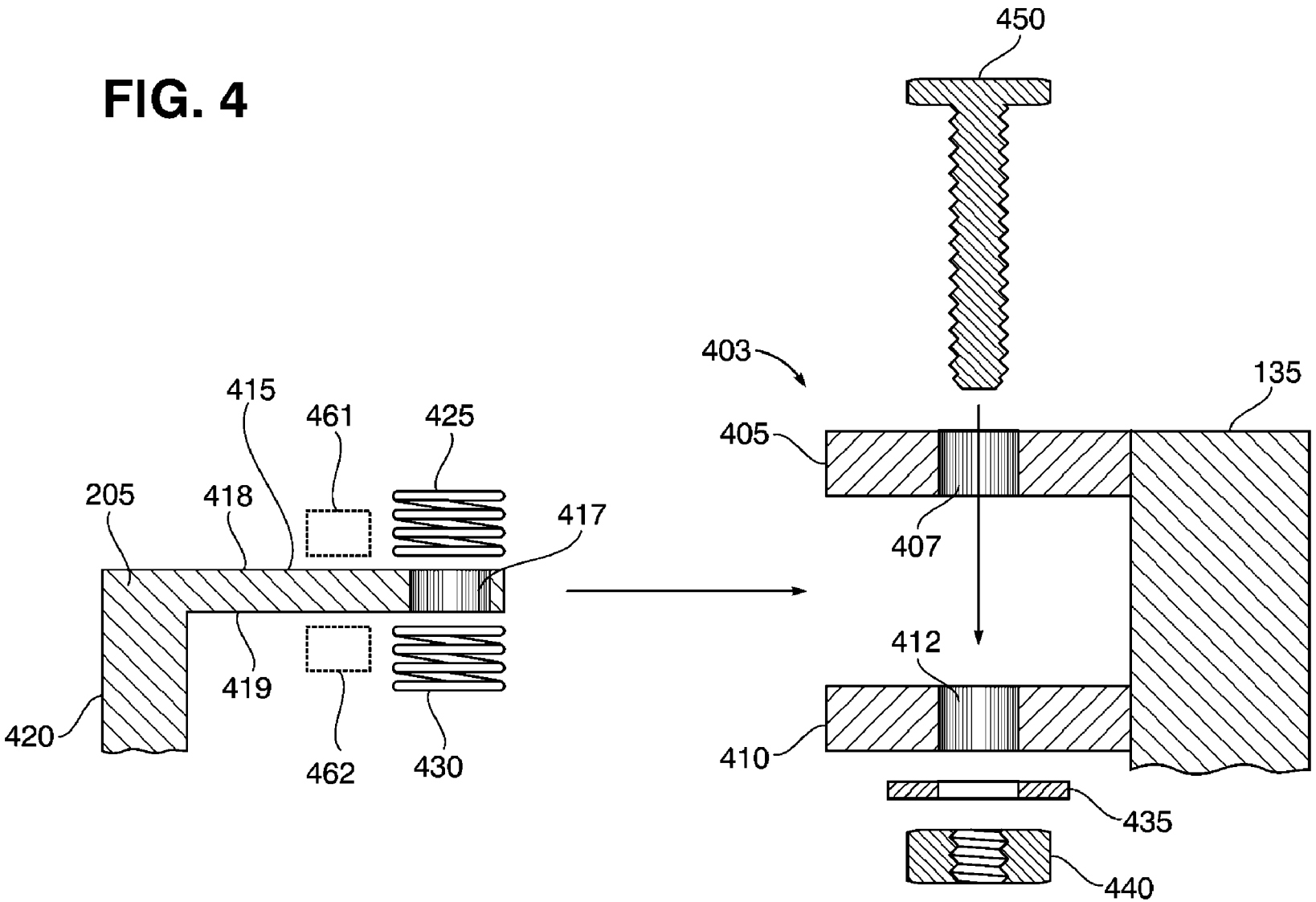
FIG. 4 illustrates an exemplary attachment mechanism for attaching the shaftless propulsion system of FIG. 2 to the exemplary marine vehicle.

FIG. 4 illustrates one exemplary mechanism for removably attaching the shaftless propulsion system 100 to the hull 215 of the marine vehicle. In particular, the collar hub 135 is attached to a stanchion 205. As shown, the collar hub 135 includes a collar hub bracket 403 with collar hub bracket arms 405, 410. Collar hub bracket arms 405, 410 have apertures 407, 412 respectively. The stanchion 205 includes a stanchion protrusion 415 extending from stanchion base 420. The stanchion protrusion 415 has an aperture 417.

To attach the collar hub 135 to the stanchion 205, the collar hub bracket arms 405, 410 of the collar hub bracket 403 are positioned over the stanchion protrusion 415 such the stanchion protrusion 415 is between bracket arms 405, 410. Collar hub bracket arm 405 is positioned over one face 418 of the stanchion protrusion 415 and collar hub bracket arm 410 is positioned over another face 419 of the stanchion protrusion 415. As shown, the face 418 is on the opposite side of the stanchion protrusion 415 from face 419.

Elastic member 425 is positioned between collar hub bracket arm 405 and face 418 of the stanchion protrusion 415. Elastic member 430 is positioned between collar hub bracket 410 and face 419 of the stanchion protrusion 415. Elastic members 425, 430 may be, for example, springs such as coil springs or leaf springs. Elastic members 425, 430 allow the hull 215 to compress during a dive without significant compression of the collar hub 135 or other components of the shaftless propulsion system 100. Thus, the marine vehicle may dive without shrinkage of the stator 115, 120 or rotor 110 diameters as the hull 215 compresses.

A bolt 450 is positioned through the aperture 407 of collar hub bracket arm 405, the aperture 417 of stanchion protrusion 417, and the aperture 412 of collar hub bracket arm 410. The bolt 450 also may be positioned through elastic members 425, 430. The bolt 450 is secured by a washer 435 and nut 440.

Some implementations may eliminate collar hub bracket arm 410 and elastic member 430. The collar hub bracket arms 405, 410 may be attached to the stanchion protrusion 415 using other known methods. At least one damping mechanism, such as damping mechanisms 460 and 461, may be used in conjunction with or in place of elastic members 425, 430.

Figure 5A:
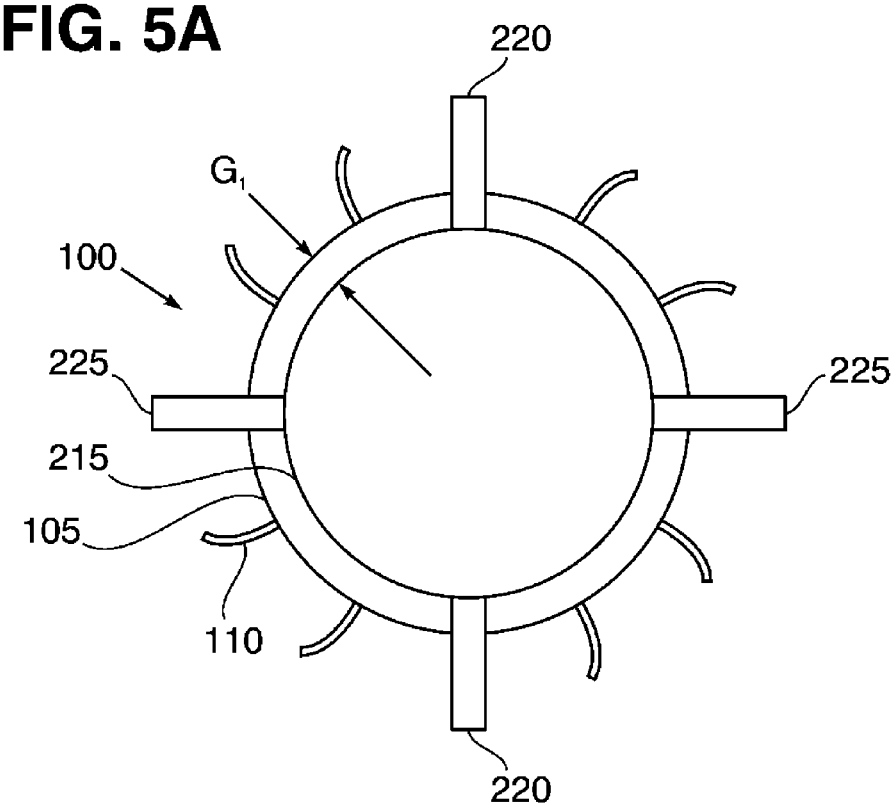
FIG. 5A is an end view of the exemplary shaftless propulsion system of FIG. 2 when the exemplary marine vehicle is at a first depth.
Figure 5B:
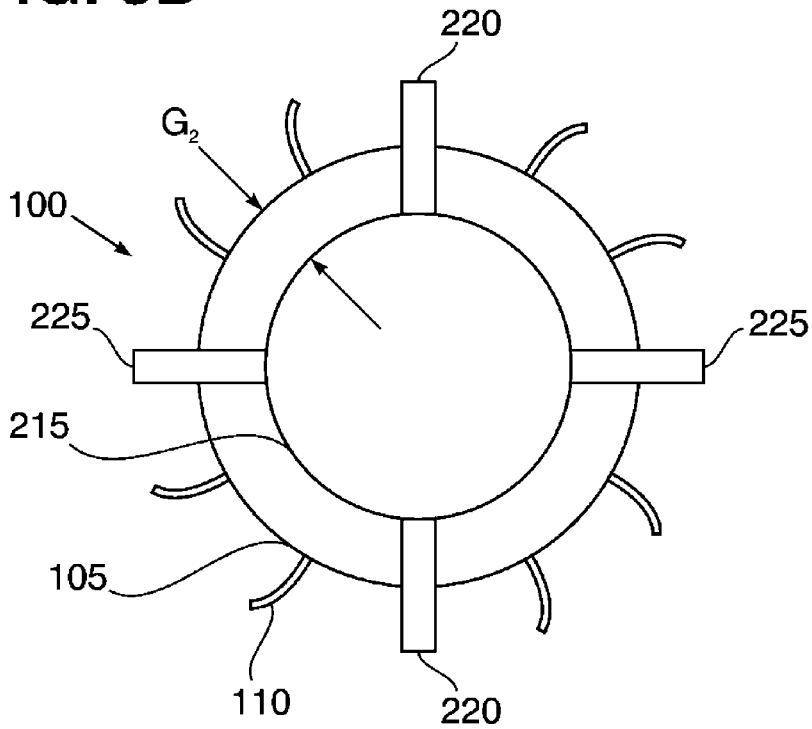
FIG. 5B is an end view of the exemplary shaftless propulsion system of FIG. 2 when the exemplary marine vehicle is at a second depth.

Referring to FIG. 5A, when the marine vehicle is at a first depth there is a first gap G1 between the hull 215 of the marine vehicle and the rotor 105 of the externally mounted shaftless propulsion system 100 that is due at least in part to compression of the hull 215 at the first depth. The rotor blades 110 and control surfaces 220, 225 also are shown. Referring to FIG. 5B, when the marine vehicle is at a second depth there is a second gap G2 between the hull 215 of the marine vehicle and the rotor 105 of the externally mounted shaftless propulsion system 100 that is due at least in part to compression of the hull 215 at the second depth. In this example the second depth is greater than the first depth, and the second gap G2 is larger than the first gap G1 because the hull 215 is compressed to a greater degree at the second depth than at the first depth. However, the diameter of the rotor 105 is not changed because the shaftless propulsion system 100 is completely surrounded by seawater external to the hull 215 of the marine vehicle due to the external mounting of the shaftless propulsion system 100. The attachment mechanism attaching the shaftless propulsion system 100 to the hull 215 compensates for the shrinkage of the hull diameter as the depth increases.

Figure 6:
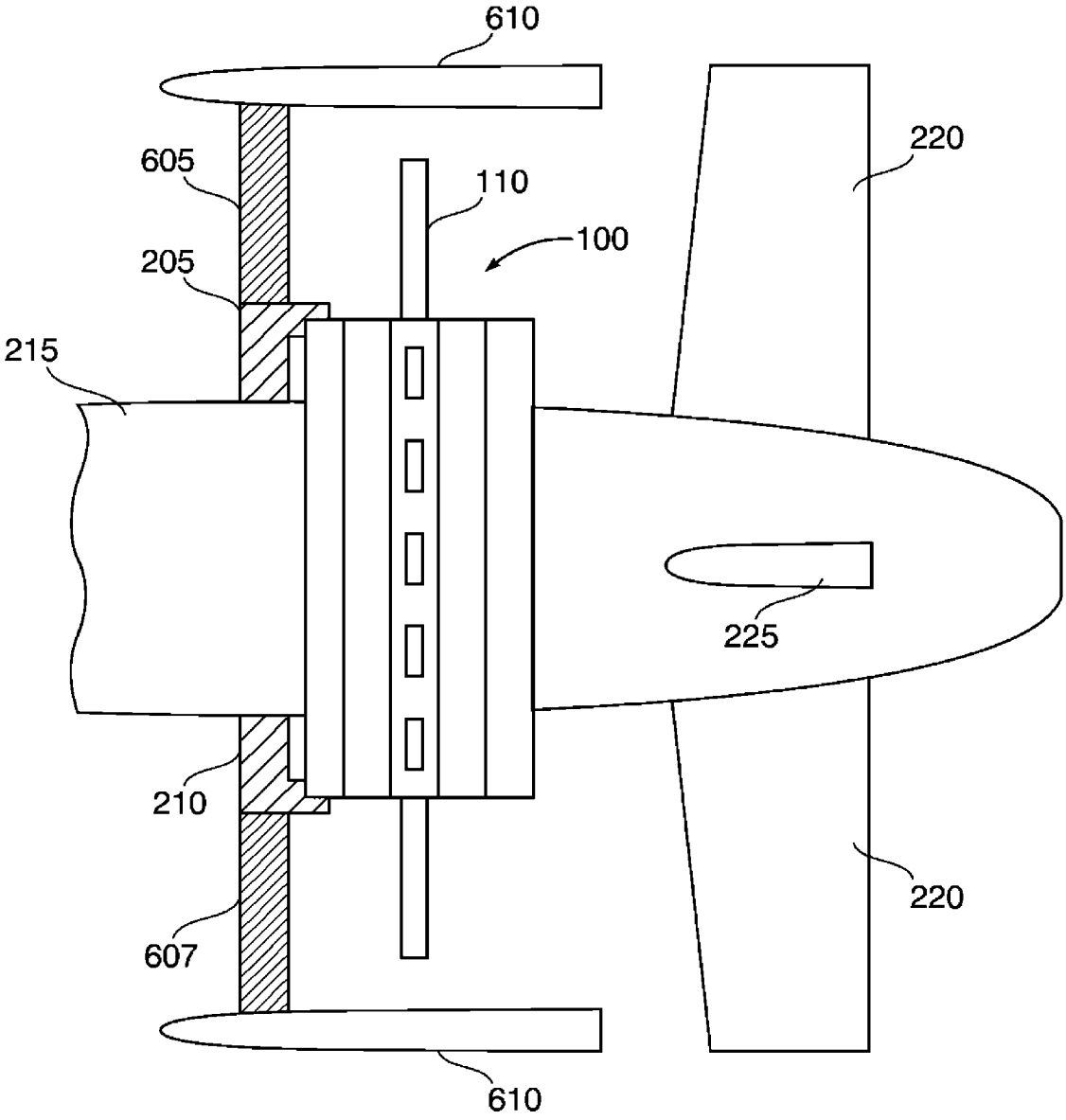
FIG. 6 is a side view of the exemplary shaftless propulsion system of FIG. 2 including an exemplary fairing.
Figure 7:
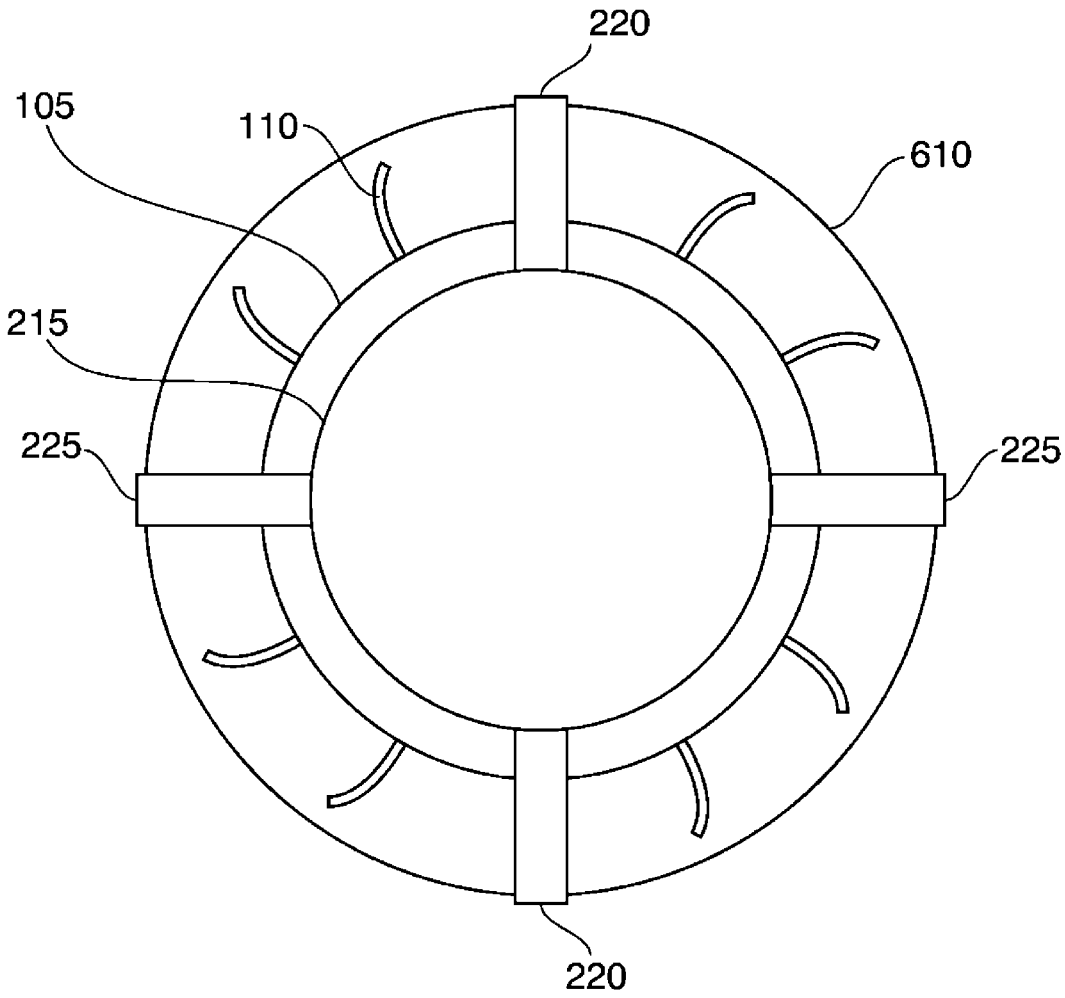
FIG. 7 is an end view of the exemplary shaftless propulsion system of FIG. 6.

FIGS. 6 and 7 illustrate an exemplary implementation of a fairing 610 for the shaftless propulsion system 100 of FIG. 2. The fairing 610 surrounds the shaftless propulsion system 100 and has sufficient clearance between the fairing 610 and the rotor blades 110 to avoid impact collisions. Fairing supports 605, 607 are used to support the fairing 610. As shown, fairing support 605 is attached to stanchion 205 and fairing support 607 is attached to stanchion 210. In some implementations, the fairing support may be part of the stanchion. In other implementations, the fairing support may be separate from the stanchion and attached directly to the hull 215. Typically, the fairing 610 is shaped so as to improve hydrodynamic performance.

A number of exemplary implementations have been described. Nevertheless, it will be understood that various modifications may be made. For example, suitable results may be achieved if the steps of described techniques are performed in a different order and/or if components in a described component, system, architecture, or devices are combined in a different manner and/or replaced or supplemented by other components. Accordingly, other implementations are within the scope of the following claims.

What is claimed is:

1. A shaftless external propulsion system comprising:

a sleeve configured to be externally mounted over a hull of a marine vehicle; and a rotor and a stator mounted on the sleeve:

wherein the rotor includes a rotor hub that cooperates with a rotor bearing to enable the rotor to rotate about the sleeve, the rotor further including rotor blades attached to the rotor hub;

wherein the rotor and the stator are disposed between a collar located at a first end of the sleeve and a collar hub located at an opposite end of the sleeve; and wherein the sleeve is removably attached to a stanchion mounted on an external surface of the hull.

2. The shaftless external propulsion system of claim 1 wherein the stanchion includes a stanchion protrusion.

3. The shaftless external propulsion system of claim 2 wherein the sleeve is removably attached to the stanchion by removably attaching the collar hub to the stanchion protrusion.

4. The shaftless external propulsion system of claim 3 wherein the collar hub includes a collar hub bracket and the collar hub bracket is removably attached to the stanchion protrusion.

5. The shaftless external propulsion system of claim 4 wherein an elastic member is positioned on a first surface of the stanchion protrusion between the first surface of the stanchion protrusion and a first surface of the collar hub bracket.

6. The shaftless external propulsion system of claim 5 wherein the elastic member is a spring.

7. The shaftless external propulsion system of claim 5 further comprising a damping mechanism positioned on the surface of the stanchion protrusion between the surface of the stanchion protrusion and the surface of the collar hub bracket.

8. The shaftless propulsion system of claim 7 wherein:

the damping mechanism is a first damping mechanism;

the surface of the stanchion protrusion is a first surface of the stanchion protrusion;

the surface of the collar hub bracket is a first surface of the collar hub bracket;

the shaftless external propulsion system further comprises a second damping mechanism positioned on a second surface of the stanchion protrusion between the second surface of the stanchion protrusion and a second surface of the collar hub bracket.

9. The shaftless external propulsion system of claim 5 wherein:

the elastic member is a first elastic member;

the surface of the stanchion protrusion is a first surface of the stanchion protrusion;

the surface of the collar hub bracket is a first surface of the collar hub bracket;

the shaftless external propulsion system further comprises a second elastic member located on a second surface of the stanchion protrusion opposite from the first surface of the stanchion protrusion and positioned between the second surface of the stanchion protrusion and a second surface of the collar hub bracket.

10. The shaftless propulsion system of claim 9 wherein the second elastic member is a spring.

11. The shaftless external propulsion system of claim 4 wherein the collar hub bracket is removably attached to the stanchion protrusion by a bolt inserted through an aperture of the collar hub bracket and an aperture of the stanchion protrusion.

12. The shaftless external propulsion system of claim 1 wherein the collar hub is removably attached to the sleeve.

13. The shaftless external propulsion system of claim 1 further comprising a fairing.

14. The shaftless external propulsion system of claim 1 wherein:

the stator is a first stator;

the shaftless external propulsion system further comprises a second stator mounted on the sleeve;

the rotor is disposed between the first stator and the second stator; and the rotor, the first stator, and the second stator are disposed between the collar located at the first end of the sleeve and the collar hub located at the opposite end of the sleeve.

15. A shaftless external propulsion system comprising:

a means for supporting a propulsor, the means for supporting being externally mounted over a hull of a marine vehicle;

a means for mounting that mounts the support means over the hull of the marine vehicle; and a propulsor comprising a rotor and a first stator mounted on the means for supporting, wherein:

the rotor includes a rotor hub that cooperates with a rotor bearing to enable the rotor to rotate about the means for supporting, the rotor further comprising rotor blades attached to the rotor hub; and the rotor and the first stator are disposed between a first means for containment of the rotor and the first stator located at a first end of the means for supporting and a second means for containment of the rotor and the first stator located at an opposite end of the means for supporting.

16. The shaftless external propulsion system of claim 15 wherein the means for mounting further comprises a means for compensating for hull contraction during a dive of the marine vehicle.

* * * * *